United States Patent [19]

Grusa

[11] 4,317,546

[45] Mar. 2, 1982

[54] COILING APPARATUS FOR FASTENER STRIPS

[75] Inventor: Bernhard Grusa, Plochingen, Fed. Rep. of Germany

[73] Assignee: Karl M. Reich Maschinenfabrik GmbH, Nuertingen, Fed. Rep. of Germany

[21] Appl. No.: 140,432

[22] Filed: Apr. 15, 1980

[30] Foreign Application Priority Data

Apr. 25, 1979 [DE] Fed. Rep. of Germany ..... 2916725

[51] Int. Cl.[3] ..... B65H 17/02; B65H 17/20; B65H 23/00

[52] U.S. Cl. ..... 242/55; 53/118; 242/67.2; 242/76

[58] Field of Search ..... 242/54 R, 55, 67.1 R, 242/67.2, 79, 80, 81, 84, 56 R, 56 A, 64, 78.1, 103, 76; 53/117, 118, 119

[56] References Cited

U.S. PATENT DOCUMENTS

| | | | |
|---|---|---|---|
| 1,823,990 | 9/1931 | Sanderson | 242/84 |
| 3,538,673 | 11/1970 | Mosetich et al. | 242/67.1 R |
| 3,645,120 | 2/1972 | Lind et al. | 242/78.1 X |
| 3,776,481 | 12/1973 | Ichikawa | 242/64 X |
| 4,175,713 | 11/1979 | Jores | 242/81 X |

*Primary Examiner*—John M. Jillions
*Attorney, Agent, or Firm*—W. G. Fasse; D. F. Gould

[57] ABSTRACT

A coiling apparatus converts longitudinal fastener strips into wound up coils. For this purpose the strip is fed through a guide track substantially tangentially to one or the other coiling or winding mandrel which may be brought into coiling or winding position by a pivot lever which carries two mandrels, one at each end. A clamping lever holds the strip so that it runs onto the mandrel.

10 Claims, 6 Drawing Figures

COILING APPARATUS FOR FASTENER STRIPS

BACKGROUND OF THE INVENTION

The invention relates to a coiling apparatus for fastener strips, the fasteners of which are connected to one another by at least one flexible harness or holding belt.

Screws, nails, pins, screw nails, and similar items of the joining technology will be included hereafter under the heading: fasteners. The fasteners may be made with heads or without heads. In order to operate screw-in or drive-in devices economically, these fasteners are typically first interconnected in so-called collators by means of harness or holding belts to form endless fastener strips which are then cut into sections having a specific length. These fastener strip sections have to be rolled up spirally in order that they may be inserted in can shaped magazines of the driving devices. Such insertion is currently done by hand and is therefore time consuming and expensive.

OBJECTS OF THE INVENTION

In view of the above it is the aim of the invention to achieve the following objects singly or in combination:

- to construct a coiling apparatus for fastener strips by means of which these fastener strips may be automatically coiled into spiral rolls;
- to construct the coiling apparatus so that it may be located immediately downstream of the collator, whereby a continuous coiling operation for the fastener strips is possible;
- to provide fastener coils which are ready for packaging as they are discharged from the coiling apparatus;
- to assure a proper winding operation by feeding the fastener strip tangentially onto the roll as it is being wound;
- to assure a continuous winding operation by switching over from one winding drum to another and vice versa;
- to modify or adjust the winding apparatus to accommodate fasteners of different lengths;
- to produce fastener strip rolls economically and efficiently; and
- to match the speed of the roll production to the output speed of the collator.

SUMMARY OF THE INVENTION

According to the invention there is provided a coiling apparatus for fastener strips which winds the strips into coils by means of at least a driven coiling mandrel supported in a machine frame for rotation about a substantially vertical axis in a position to receive the strip from two parallel strip guide tracks on which the strip is movably supported. A strip holding device is arranged at the coiling mandrel. Preferably the coiling mandrel is tiltable for convenient exchange against another coiling mandrel of the same type. The mandrel which is in the coiling position is positively driven while the other mandrel in the ready position is not yet driven. The strip guide channel is adjustable in its depth to accommodate fasteners of different length.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
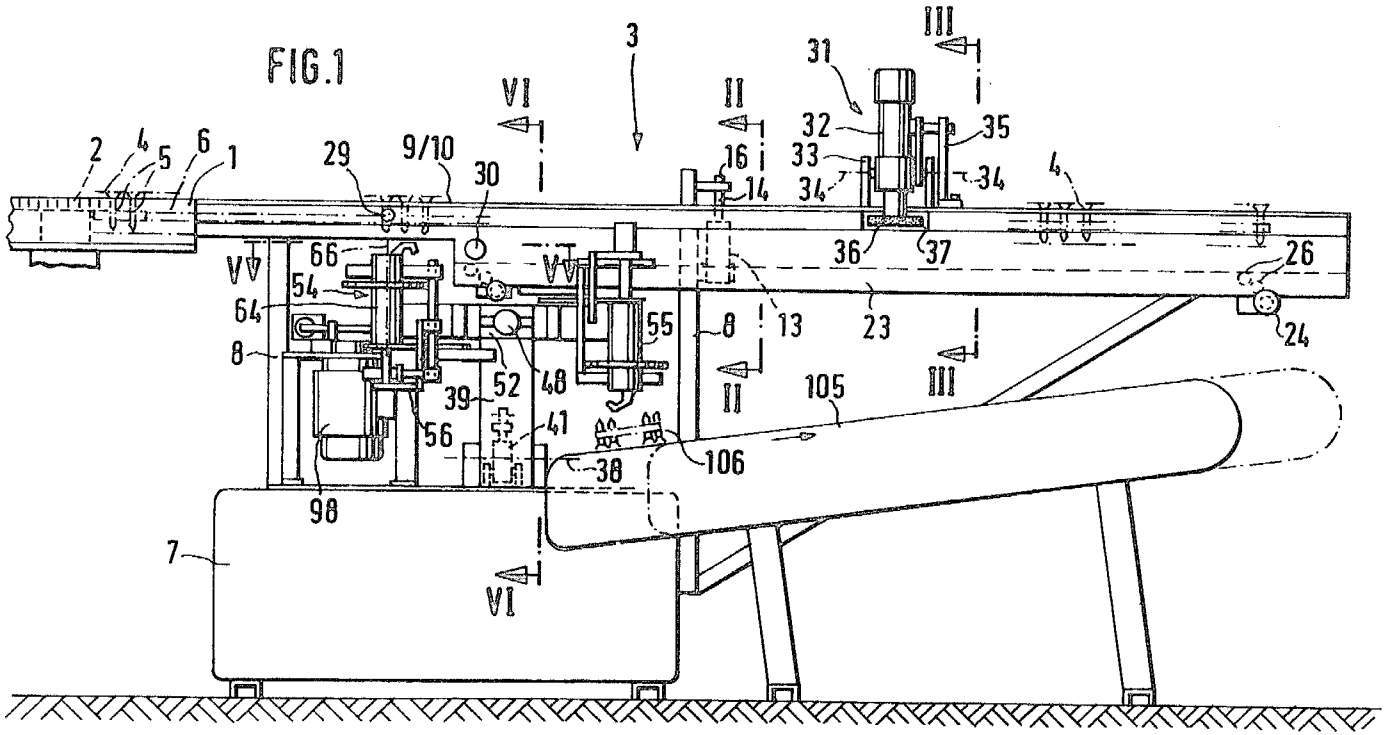
FIG. 1 shows a front elevational view of the coiling apparatus of the invention.

FIG 1 shows the output track 1 with a conveying chain 2 of a collator (not shown), but arranged upstream of a coiling apparatus 3. Fastener strips 4 supported in the output track 1 are moved by the conveying chain 2 in the direction of the coiling apparatus 3. The fasteners 5 of the fastener strips 4 are interconnected together by means of a flexible harness of belt 6 so that the shafts of the fasteners extend in parallel to one another.

Figure 2:
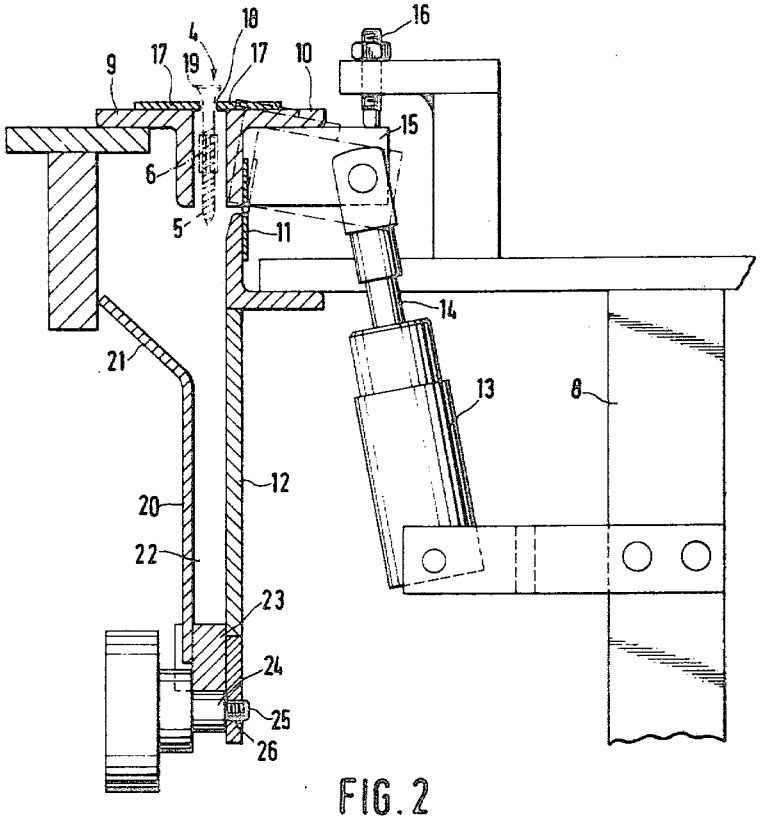
FIG. 2 shows a section along the line II—II in FIG. 1.

The coiling apparatus 3 has a frame 7. Parallel guiding tracks 9 and 10 are arranged on supports 8 in the frame 7. As shown in FIG. 2, the guiding track 9 is rigidly connected to the base structure 7, while the guiding track 10 is attached to a hinge 11, which is connected to a rear ,wall 12 of the frame 7.

A cylinder 13 for pressurized air, is pivotally attached to the support 8. The piston rod 14 of the cylinder 13 is connected to the guiding track 10 by means of a fish plate 15. The fish plate 15, in the position as shown in FIG. 2 with full lines, is pressed against an adjustable stop screw 16. In this position, the guiding tracks 9 and 10, provided with the guide strips 17, form a slot 18. The fastener strip 4, suspended by the heads 19 of the fasteners 5, is movably supported in the slot 18. A front wall 20 is arranged opposite the rear wall 12. The front wall 20 has a funnel shaped slant 21 sloping toward the guiding tracks 9, 10, and together with the rear wall 12 forms a chute 22 which is closed at the bottom by a support plate 23.

This support plate 23 rests on a screw pin 24. Threaded bores 26 displaced from one another in height, are provided on the rear wall 12 for the screw threads 25 of the screw pins 24. By screwing the screw pins 24 into one of the threaded bores 26, the support plate 23 may be adjusted in height so that its position may be adapted to fasteners 5 of different lengths.

Figure 5:
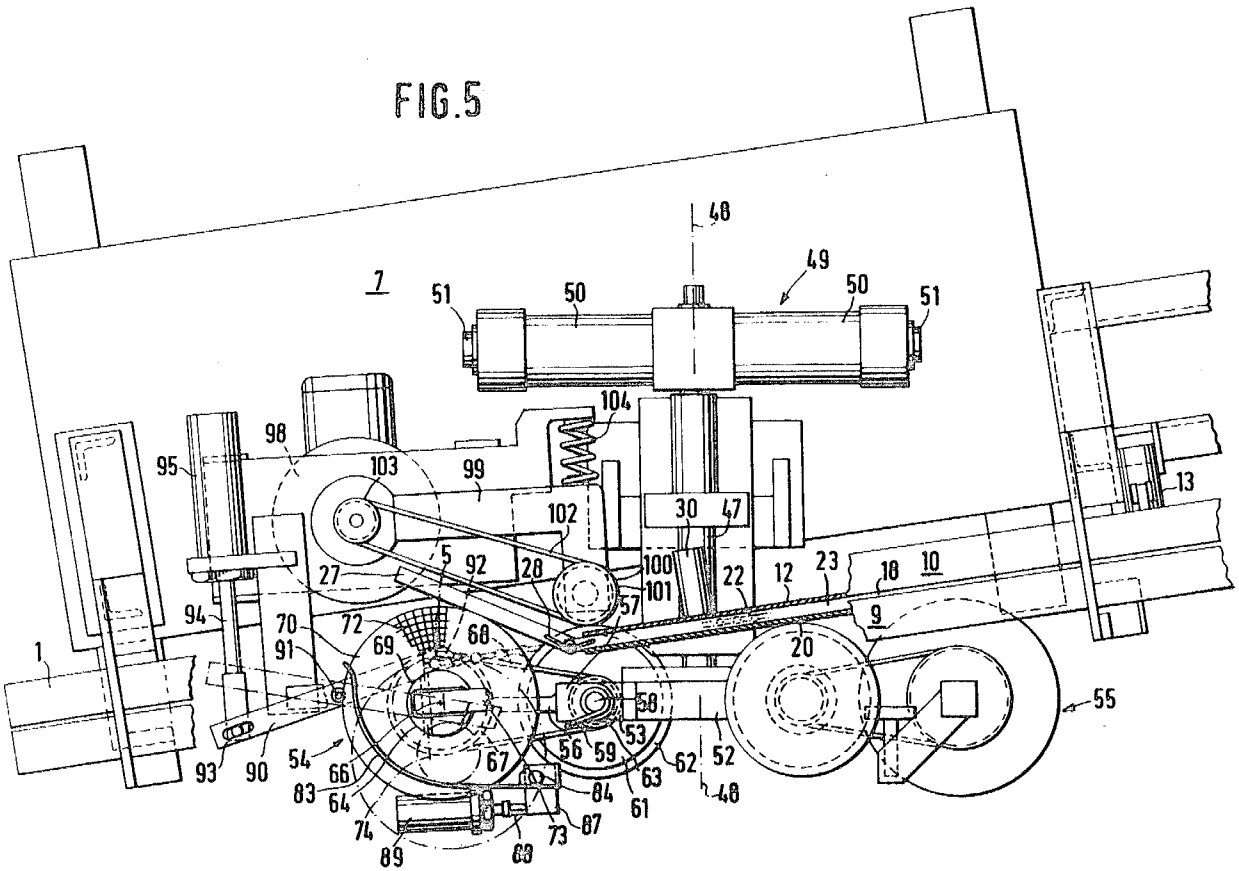
FIG. 5 shows a partial view of the coiling apparatus as seen from above partially in section along the line V—V in FIG. 1.

As FIG. 5 also shows, the support plate 23 is provided with a support member 27 at the end facing the collator. The support member 27 is pivotally carried on the support plate 23 for tilting about a vertical axis against the force of a lever spring 28.

Figure 4:
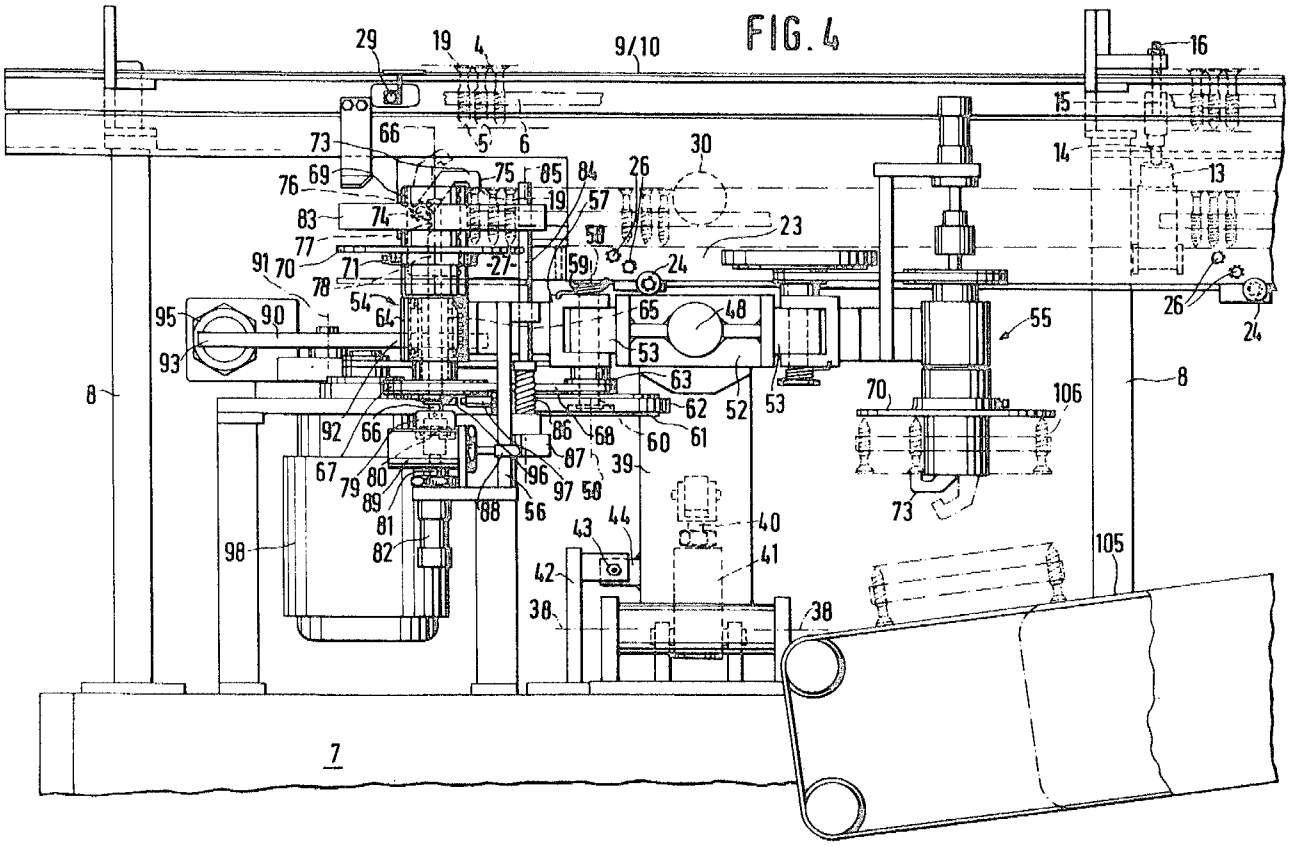
FIG. 4 shows a partial view similar to that of FIG. 1 of the present coiling apparatus.

In order to control the coiling apparatus, a light barrier 29 is arranged on the input end of the guiding track 9, and an inductive proximity switch 30 is arranged on the rear wall 12 at the level of the chute 22 (FIG. 1 and FIG. 4).

Figure 3:
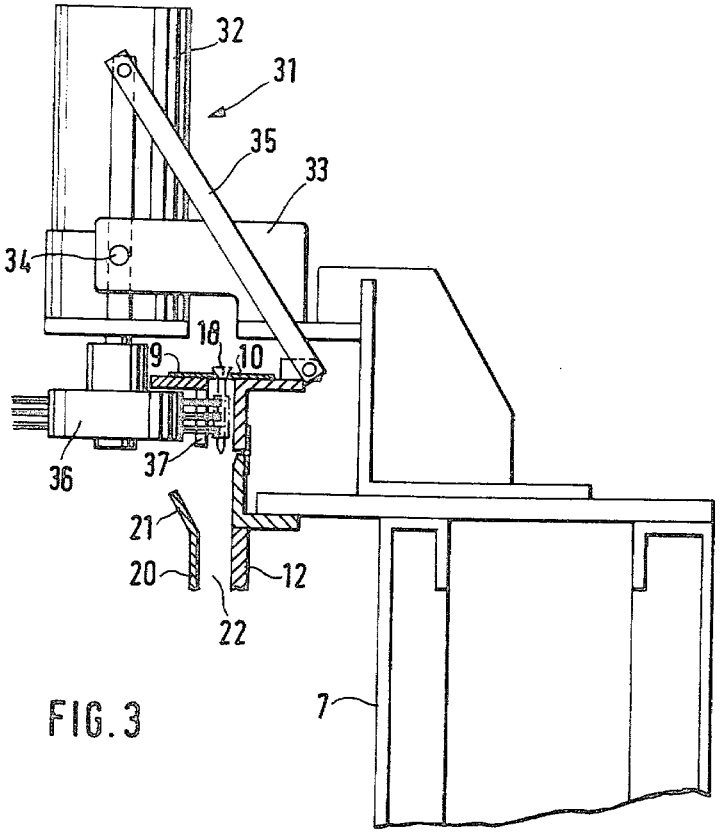
FIG. 3 shows a section along the line III—III in FIG. 1.

Further, FIGS. 1 and 3 show a conveying means 31 for the fastener strip 4. The motor 32 of the conveying means 31 is pivotally attached to a fork 33 connected to the base frame 7, whereby the motor 32 may be tilted about an axis 34—34. The motor 32 is also hinged to the guiding track 10 by means of a guide rod 35. A brush wheel 36 driven by the motor 32 extends into a cut-out 37 of the guiding track 9 in such a manner, that the brush wheel can exert an advancing force on the fastener strip 4 suspended in the slot 18.

Figure 6:
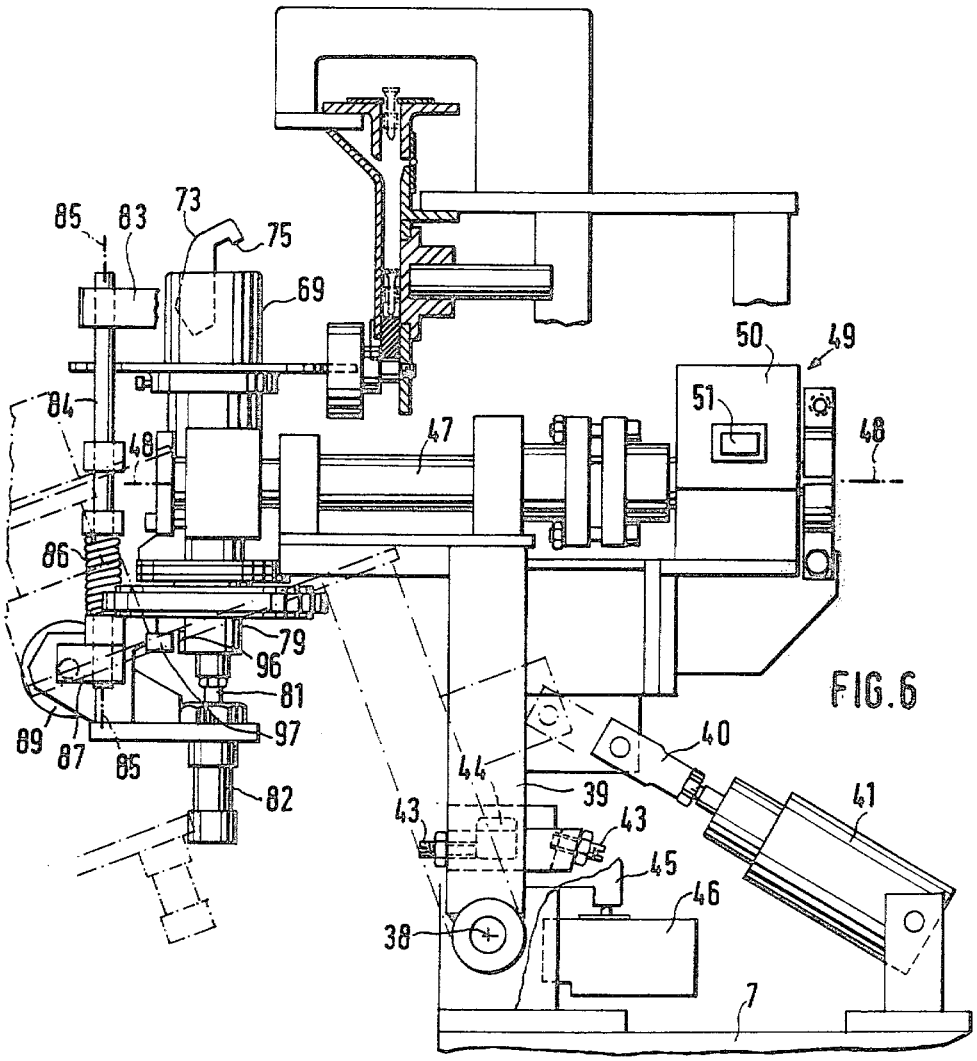
FIG. 6 shows a section of the apparatus of FIG. 1 along the line VI—VI.

The portion of the coiling apparatus thus far described serves to take up the fastener strip 4 from the collator. The construction of the actual coiling apparatus will be described in the following. Referring to FIGS. 1, 4, and 6 a tilting lever 39 is tiltably supported on the frame 7 about a horizontal axis 38—38. The piston rod 40 of a pressurized air cylinder 41 pivotally supported on the frame 7, is hinged to the tilting lever 39.

A support 42 is attached to the frame 7 adjacent the tilting lever 39. The support 42 is provided with two adjusting screws 43, which cooperate with a fish plate 44 connected to the tilting lever 39 (FIG. 4). A cam 45 cooperating with a switch 46 arranged on the frame 7 is also connected to the tilting lever 39 (FIG. 6).

A pivoting shaft 47 forming the axis 48—48 is supported at the upper end of the tilting lever 39 (see FIG. 5). The rear end of the pivoting shaft 47 is connected to a compressed air driven tilting drive 49, which is provided with two oppositely arranged air pressure cylinders 50. A pressure switch 51 is associated with each air pressure cylinder 50.

The pivoting shaft 47 carries a pivoting lever 52 at its forward end. The pivoting lever 52 has two opposingly directed bearing brackets 53. The two coiling mandrels 54 and 55 are arranged on the bearing brackets 53. The two coiling mandrels are constructed completely alike, however with relation to their vertical orientation, they are directed to oppose each other. Thus, only the coiling mandrel 54 directed to the left in FIG. 4 will be described below in detail. This description is also equally valid for the coiling mandrel 55 located to the right.

A bracket 56 with a fork 57 is pivotally supported about an axis 58—58 on the bearing bracket 53. A spring clip 59 located concentric with the axis 58—58 exerts a clockwise directed force on the bracket 56 and pushes it against a stop which is not shown, (FIG. 5).

In addition, a freely rotatable friction wheel 61 is supported on a pivot pin 60 coaxially with the axis 58—58. The friction wheel 61 has a friction ring 62 and is rigidly connected to a pulley 63.

FIG. 4 shows a bearing sleeve 64 connected to the bracket 56. The hollow shaft 64 is supported in the bearing sleeve 64 to freely rotate about an axis 66—66. The lower end of the shaft 65 is connected to another pulley 67, which is coupled to the pulley 63 by means of a v-belt 68.

The upper end of the shaft 65 is connected to a coiling cylinder 69. A supporting disk 70 secured to coiling cylinder 69 may be adjusted with reference to height or elevation. The supporting disk 70 is rigidly clamped to the coiling cylinder 69 by means of the clamping screw 71 at the desired elevation depending on the length of the fasteners. The two end positions are illustrated in FIG. 4 by full lines and by dash-dotted lines.

As shown in FIG. 5, the bearing surface of the supporting disk 70 is provided with radial and circular grooves 72 which serve to hold fast the tips of the fasteners 5.

A clamping lever 73 is operatively connected to the coiling cylinder 69 for tilting about an axis 74—74 to hold the fasteners 5 (FIGS. 4 and 5). A claw 75 presses on the head 19 of a fastener 5 for this purpose. A pinion gear 76 cooperating with gear teeth 77 is rigidly connected to the clamping lever 73. These gear teeth 77 are attached to the end of a shifting lever 78 which is supported in the hollow shaft 65 so that it is axially movable. The other end of the shifting lever 78 is connected to a coupling sleeve 79. The coupling pin 80 of a piston rod 81 extends into the coupling sleeve 79, so that the shifting lever 78 of the piston rod 81 is carried along axially. The coupling sleeve 79 is supported on the coupling pin 80 so that it is freely rotatable. The piston rod 81 may be activated by a compressed air cylinder 82 which is rigidly connected to the bracket 56.

An additional holding means for the fastener strip 4 during the coiling process, is formed by a holding finger 83 which partially encloses the coiling cylinder 69 and is pivotally supported on the bracket 56 by means of a supporting rod 84 so that it may pivot about an axis 85—85 parallel to the axis 66—66. A clip spring 86 acts upon the supporting rod 84 exerting a force on the holding finger 83 directed towards the coiling cylinder 69. An actuating cam 87 is attached to the end of the supporting rod 84 opposite the holding finger 83. The piston rod 88 of a pressurized air cylinder 89 which is also fastened to the bracket 56, acts upon said actuating cam 87.

The diameter of the fastener strip roll becomes larger during the coiling process. Consequently, it is necessary to swing the coiling mandrel 54 away from the chute 22 to an extent corresponding to the increase in diameter. This is accomplished by means of a two-armed follow-up lever 90 which is pivotally supported on base frame 7 about an axis 91—91 (FIG. 5). The follow-up arm 92 of the two-armed follow-up lever 90 cooperates with the bearing sleeve 64 of the coiling mandrel 54. The other arm 93 is connected to the piston rod 94 of a pressurized air cylinder 95 which is attached to base frame 7.

The end of the shaft 65 is provided with a cam 96 for controlling the clamping lever 73. The cam 96 cooperates with a proximity switch 97 attached to the bracket 56.

A motor 98 is arranged on the base frame 7 for driving the coiling cylinder 69. The motor 98 of the present example embodiment is formed by a rotating field magnet. An angle lever 99 is supported tiltably on base frame 7 on the same axis as the motor 98. A pulley 100 and a wheel 101 opposing the friction wheel 61 are supported on the free end of the angle lever 99 so that they are freely rotatable. The pulley 100 is connected to the pulley 103 of the motor 98 by means of a v-belt 102. A compression spring 104 supported against base frame 7 exerts a clockwise directed force against the angle lever 99, (FIG. 5).

A conveyor belt 105 may be provided as shown in FIG. 1 for supplementing the coiling apparatus. The conveyor belt 105 takes the already coiled fastener strip rolls 106 from the coiling mandrel 55 and carries them to a packing station, not shown.

In operation, the fastener strip 4 has been produced in the collator and has already been cut to the desired length. The fastener strip 4 is pushed, guided by the conveying chain 2, into slot 18 of the output track 1 between the guiding tracks 9 and 10 of the coiling apparatus 3. The light barrier 29 is hence influenced by the fastener strip 4 and consequently switches on the conveying member 31. The brush wheel 36 of the conveying member 31 takes over the conveying of the fastener strip 4 until the end of the fastener strip 4 has passed by the light barrier 29, whereby the conveying member 31 is switched off. The sliding of the fastener strip 4 by the conveying member 31 is accelerated relative to the sliding movement of the conveying chain 2.

The light barrier 29 causes an activation of the pressurized air cylinder 13 simultaneously with the switching off of the conveying member 31. The compressed air cylinder 13 swings the guiding track 10 away from the slot 18 so that the complete length of the fastener strip 4 falls into the chute 22 and stands upright on its tips on the support plate 23. A delaying means (not illustrated) causes the guiding track 10 to be swung back into its support position. The time gained as a result of the acceleration of the fastener strip 4 by the conveying member 31 makes it possible to swing open the guiding track 10 without impairing the continuous output of the collator.

An inductive limiting or proximity switch 30 is influenced by the fastener strip 4 as it enters into the chute 22. The inductive proximity switch 30 causes the tilting lever 39 to be tilted by means of pressurized air cylinder 41 from the discharging position illustrated by the dash-dotted line in FIG. 6 into the coiling position shown by the full line. As shown in FIG. 5, the supporting disk 70 of the coiling mandrel 54 then slides under the forward end of the fastener strip 4 thereby swinging the support member 27 away from the fastener strip 4. Meanwhile the rear adjusting screw 43 (FIG. 6) tilts the coiling mandrel 54 far enough so that the first fastener 5 of the fastener strip 4 rests against the coiling cylinder 69.

As the coiling mandrel 54 swings in, the friction ring 62 of the friction wheel 61 is also pressed against the opposing wheel 101 which is constantly driven by the motor 98. Consequently, the coiling cylinder 69 is caused to rotate by the v-belt 68. In order for the fastener strip 4 to be carried along, the clamping lever 73 must be activated through the shifting lever 78 by means of the pressurized air cylinder 82 so that the claw 75 of the clamping lever 73 presses against the head 19 of the first fastener 5 and clamps it fast to the supporting disk 70. An activating of the clamping lever 73 only occurs, however, when the following conditions are satisfied:

(1) The inductive proximity switch 97 must be damped by the cam 96 in order to indicate that the rotating clamping lever 73 has reached the proper angular position; and (2) The activated switch 46 (FIG. 6) indicates that the coiling mandrel 54 is in the coiling position; and (3) The pressure switch 51 associated with the activated pressurized air cylinder 50 of the pivot drive 49 indicates which of the two coiling mandrels 54 or 55 is ready for coiling.

The holding finger 83 is activated by the compressed air cylinder 89 through the supporting rod 84 simultaneously with the activating of the clamping lever 73. The holding finger 83 adjusts, by means of spring tension, to the increasing diameter of the fastener strip roll. It is advantageous, for a satisfactory coiling, that the fastener strip 4 resting in the chute 22, always meets the fastener strip roll tangentially during the coiling operation. In order to accomplish this, the coiling mandrel 54 is arranged on the bearing bracket 53 for pivoting or tilting about the axis 58—58 against the effect of the clip spring 59, and it is swung counter clockwise by the compressed air activated follow-up lever 90 during the coiling operation (FIG. 5).

The end of the coiling process is indicated by the proximity switch 30 past which the end of the fastener strip 4 has travelled. The proximity switch 30 controls the cylinder 41 so that the tipping lever 39 and hence the coiling mandrels 54 and 55 are tipped into the discharge position. The friction wheel 61 disengages from the opposing wheel 101 and the rotating of the coiling mandrel 54 is stopped. The pivot drive 49 is simultaneously activated so that it swings the pivot lever 52 through 180° by means of the pivot shaft 47. The coiling mandrel 54 thus reaches the position of the coiling mandrel 55, whereby the fastener strip roll with the tips of the fasteners 5 pointing upwardly, is held against the supporting disk 70 by means of the clamping lever 73 and the holding finger 83. As soon as the next fastener strip 4 is taken up by the coiling mandrel 54 for coiling, the clamping lever 73 of the coiling mandrel 55 is swung into the position indicated by the dash-dotted line, so that the fastener roll 106 may drop down onto the conveyor belt 105.

It is advantageous to control the illustrated example embodiment by combined electric and pneumatic means. The fastener strips 4 to be worked trigger the individual operations; the swinging of the pivot lever 52 is triggered by a pneumatic counting circuit.

The support plate 23 may be adjusted in its elevational position to adapt the coiling apparatus to fasteners 5 of different lengths. Accordingly, the adjusting screw pin 24 may be screwed into appropriate threaded bores 26 of the rear wall 12. The supporting surface of the supporting disk 70 may then be matched to the supporting surface of the support plate 23, in that the supporting disk 70 is shifted along the coiling cylinder 69 to the desired level and is clamped fast by means of a clamping screw 71.

Although the invention has been described with reference to specific example embodiments, it is to be appreciated that it is intended to cover all modifications and equivalents within the scope of the appended claims.

What is claimed is:

1. A coiling apparatus for fastener strips comprising:

(a) base frame means, parallel guide track means including two parallel rails operatively supported by said base frame means for movably carrying a fastener strip in said guide track means so that the individual fasteners extend substantially vertically with their longitudinal axis, (b) drivable coiling mandrel means operatively arranged relative to said guide track means for receiving a fastener strip from said guide track means, substantially vertically arranged axis means holding said coiling mandrel means, (c) holding means for said fastener strip, arranged to hold a fastener strip so that it moves onto the coiling mandrel means, and (d) means (13, 14, 15) for movably securing at least one of said rails of said guide track means to said base frame means.

2. The coiling apparatus of claim 1, further comprising bearing bracket means for said coiling mandrel means, substantially horizontal axis means for pivotally supporting said bearing bracket means on said base frame means, journal axis means (58) on said bearing bracket means extending in parallel to the rotational axis of said coiling mandrel means, said coiling mandrel means being operatively secured to said journal axis means, whereby the coiling mandrel means is tiltable about said journal axis means (58).

3. The coiling apparatus of claim 2, wherein said bearing bracket means comprise at least two bearing brackets connected to one another and forming a pivot lever (52), said coiling mandrel comprising two mandrels one of which is arranged on each bearing bracket respectively.

4. The coiling apparatus of claim 3, further comprising substantially horizontal axis means (38), tilting lever means (39) operatively secured to said base frame means by said axis means (38), said pivot lever (52) being operatively supported on said tilting lever means (39).

5. The coiling apparatus of claim 4, further comprising motor means operatively supported in said base frame means, friction drive means operatively interposed between said motor means and said coiling mandrel means, said friction drive means becoming operative when said tilting lever means (39) is tilted into the coiling or winding position, whereby in any one instant but one coiling mandrel is positively driven.

6. The apparatus of claim 1, further comprising guide chute means arranged below said guide track means, said guide chute means comprising a movable bottom member and adjustment means operatively connected to said movable bottom member for adjusting the elevational position of said bottom member.

7. The apparatus of claim 6, further comprising support carrier means (27) movably supported at the end of said guide chute means facing toward said coiling mandrel means, said apparatus further comprising support disk means operatively connected with said coiling mandrel means and arranged for cooperation with said support carrier means when said coiling mandrel means is in a strip winding position.

8. The coiling apparatus of claim 1, wherein said holding means comprise a clamping lever (73) including a claw, and means tiltably securing said clamping lever to said coiling mandrel means, said claw operatively holding a fastener strip when said coiling mandrel means is in a winding position, said apparatus further comprising actuating means (81, 82) operatively connected to said holding means for actuating said clamping lever into a strip holding position.

9. The coiling apparatus of claim 8, wherein said actuating means comprise piston cylinder means, rack and pinion means operated by said piston means for positioning said clamping lever.

10. The apparatus of claim 1, wherein said holding means further comprise a holding finger (83) for pressing a fastener strip against said coiling mandrel means, said apparatus further comprising support means for said holding finger, said support means including a journal axis (84) for said holding finger, said journal axis (84) extending in parallel to the rotational axis of said coiling mandrel means, and means (88, 89) operatively connected to said holding finger for pressing the latter against the fastener strip as it is being coiled.

* * * * *